US012215425B2

(12) United States Patent
Kim

(10) Patent No.: US 12,215,425 B2
(45) Date of Patent: Feb. 4, 2025

(54) APPARATUS FOR COOLING METAL MATERIAL

(71) Applicant: POSCO, Pohang-si (KR)

(72) Inventor: Jung-Kuk Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 842 days.

(21) Appl. No.: 17/414,731

(22) PCT Filed: Dec. 17, 2019

(86) PCT No.: PCT/KR2019/017868
§ 371 (c)(1),
(2) Date: Jun. 16, 2021

(87) PCT Pub. No.: WO2020/130566
PCT Pub. Date: Jun. 25, 2020

(65) Prior Publication Data

US 2022/0064773 A1 Mar. 3, 2022

(30) Foreign Application Priority Data

Dec. 17, 2018 (KR) ..... 10-2018-0163563

(51) Int. Cl.
*C23C 2/00* (2006.01)
*C23C 2/26* (2006.01)
*C23C 2/28* (2006.01)

(52) U.S. Cl.
CPC ..... *C23C 2/29* (2022.08); *C23C 2/003* (2013.01); *C23C 2/26* (2013.01); *C23C 2/50* (2022.08)

(58) Field of Classification Search
CPC .... C23C 2/29; C23C 2/26; C23C 2/20; C23C 2/18; C23C 2/16; C23C 2/06;
(Continued)

(56) References Cited

U.S. PATENT DOCUMENTS 6,301,906 B1 * 10/2001 Thiel ..... C21D 1/667 72/201
7,294,215 B2 * 11/2007 Tsuyama ..... C21D 9/46 148/637

(Continued)

FOREIGN PATENT DOCUMENTS

CN 101376960 3/2009
CN 105339103 2/2016

(Continued)

OTHER PUBLICATIONS

European Search Report—European Application No. 19900501.8 issued on Feb. 25, 2022, citing JP S61-257429, KR 10-0887862, and US 2017/0002451.

(Continued)

*Primary Examiner* — Jessee R Roe
*Assistant Examiner* — Michael Aboagye
(74) *Attorney, Agent, or Firm* — CANTOR COLBURN LLP

(57) ABSTRACT

Provided is an apparatus for cooling a metal material, the apparatus comprising: a spray cooling unit for spraying a cooling medium onto the surface of a metal material; and a spray amount control unit which regulates the rate of passage of the cooling medium sprayed from the spray cooling unit onto the edge region of the metal material, and controls the spray amount of the cooling medium.

20 Claims, 13 Drawing Sheets

(58) Field of Classification Search
CPC .. C23C 2/003; C23C 2/28; C23C 2/40; C23C 2/50; B05B 1/005; B05B 12/34; C21D 1/667; C21D 1/00
USPC ..... 266/259
See application file for complete search history.

(56) References Cited

U.S. PATENT DOCUMENTS

| | | | | |
|---|---|---|---|---|
| 10,233,527 | B2 * | 3/2019 | Kim | C23C 2/04 |
| 2014/0356548 | A1 | 12/2014 | Jang et al. | |
| 2016/0047027 | A1 | 2/2016 | Langevin et al. | |
| 2017/0002451 | A1 | 1/2017 | Kim et al. | |
| 2019/0390316 | A1 | 12/2019 | Kim | |

FOREIGN PATENT DOCUMENTS

| | | | | |
|---|---|---|---|---|
| CN | 105934531 | | 9/2016 | |
| CN | 207769002 | | 8/2018 | |
| EP | 1634657 | B1 * | 2/2012 | B21B 45/0218 |
| EP | 3369839 | | 9/2018 | |
| JP | S61257429 | | 11/1986 | |
| JP | H07003337 | | 1/1995 | |
| JP | 2000297331 | | 10/2000 | |
| JP | 2006265665 | | 10/2006 | |
| JP | 2017503927 | | 2/2017 | |
| KR | 20030048597 | | 6/2003 | |
| KR | 20070117405 | | 12/2007 | |
| KR | 20080000908 | | 1/2008 | |
| KR | 100887862 | | 3/2009 | |
| KR | 20130034355 | | 4/2013 | |
| KR | 20130074268 | | 7/2013 | |
| KR | 20130074269 | | 7/2013 | |
| KR | 20150089324 | | 8/2015 | |
| KR | 20170051599 | | 5/2017 | |
| KR | 101819386 | | 1/2018 | |
| KR | 20190074628 | | 6/2019 | |

OTHER PUBLICATIONS

International Search Report—PCT/KR2019/017868 dated Aug. 28, 2020.

Chinese Office Action—Chinese Application No. 201980083850.3 issued on Jul. 1, 2022, citing CN 105934531, CN 207769002, KR 10-2003-0048597, JP S61-257429, JP 2000-297331, CN 101376960, and CN 105339103.

Japanese Office Action—Japanese Application No. 2021-534395 issued on Jul. 26, 2022, citing JP 2017-503927.

* cited by examiner

APPARATUS FOR COOLING METAL MATERIAL

TECHNICAL FIELD

The present disclosure relates to an apparatus for cooling a metal material.

BACKGROUND ART

It should be noted that the description described in this section merely provides background information on the present disclosure and does not constitute the prior art.

Referring to FIG. 1, a steel sheet 1 (cold-rolled steel sheet) uncoiled from a pay-off reel may be heat-treated through a welding machine and a looper, may pass through a snout and a sink roll 4 and stabilizing rolls 5 of a plating bath 2 such that molten metal, such as, for example, molten zinc 3 may be coated on a surface of the steel sheet 1, and a the gas wiping facility 6 (also known as an "air knife") may spray a high-pressure gas to control a plating thicknesses of the steel sheet 1.

Also, the plated steel sheet 1 may be plated by passing through a vibration damping facility 7, a cooling apparatus 8, and transfer rolls 9, and the vibration damping facility may uniformly perform control of the plating thickness by suppressing vibrations of the steel sheet 1.

Here, the cooling apparatus 8 may also be known as a cooling tower because the cooling apparatus 8 may be provided on both side surfaces of the steel sheet 1 which may usually be vertically transferred.

The cooling apparatus for cooling a plated steel sheet may solidify the liquid zinc plating layer coated on the surface of the plated steel sheet of high temperature which may be vertically transferred, and may rapidly cool the temperature of the steel sheet 1 to 300° C. or less before the transfer roll 9 so as to smoothly perform the transfer of the steel sheet 1 or a subsequent process.

Referring to FIG. 2, in a general cooling apparatus 8, air sprayed by a nozzle may be vertically sprayed on the steel sheet 1, and may be dispersed in upward/downward and width directions after the air collides with the steel sheet 1.

In particular, referring to FIG. 3*a*, on both edges of the steel sheet 1, the air sprayed by the nozzle may be discharged to a side surface of a chamber having relatively low pressure after the air collides with the steel sheet 1.

The air sprayed by the nozzle, which may have a high flow rate, may cause a flow on the surface of the plating layer while moving to the side surface after strong impact on the steel sheet.

Accordingly, as both side edge regions of the steel sheet 1 may be relatively rapidly cooled as compared to a central region on which high atmosphere temperature is formed, a deviation in temperatures of the steel sheet 1 may increase in a width direction, which may be problematic.

As compared to the GI product (solidification range: 430-450° C.), which may be instantly solidified immediately after the air knife, the high-corrosion-resistant plated steel sheet may have a long solidification completion section due to a low solidification point (solidification range: 380-450), and it may be highly likely that a plating layer pattern defect may occur by the air sprayed by the nozzle colliding with the steel sheet in the non-solidification section.

In particular, in the case of post-plating with a large amount of plating, fine comb patterns may be greatly formed on both edges of the steel sheet, which may be a major cause of deterioration of surface quality and reduction of corrosion resistance.

In the case of a medium width material with a large width of the steel sheet, the width of colliding pressure of the vertically sprayed air may be large, and a temperature deviation between the center and both edges of the steel sheet may be large as compared to a narrow width material.

Also, referring to FIG. 3*b*, the sprayed air colliding with both edges may be discharged to the side surface, such that the temperature of the edge may be lowered, and accordingly, solidification of the plating layer may occur earlier than in the center of the steel sheet, and in this case, a fine comb pattern may be formed on the surface of the plating layer by strong collision of the sprayed air and a discharge flow on the side surface.

In particular, high corrosion resistance with a long solidification section may greatly form a large amount of comb patterns on both edges in post-plating, which may be a major cause of deterioration of surface quality and degradation of corrosion resistance of the plating layer Therefore, the high corrosion-resistant plated steel sheet may require a nozzle spraying method which may reduce impact pressure of the sprayed air on both edges and may secure a maximum cooling flow rate in the section in which the plating layer is not solidified, and which may change the form of spraying to both edge depending on a production material (GI, high corrosion resistance).

DISCLOSURE

Technical Problem

One aspect of the present disclosure is to provide an apparatus for cooling a metal material which may, by lowering collision pressure with a metal material, prevent surface defects, such that surface quality may improve.

One aspect of the present disclosure is to provide an apparatus for cooling a metal material which may enable uniform cooling of an edge region of a metal material through induction refinement of a cooling medium, thereby improving cooling performance.

Technical Solution

As one aspect to obtain the purpose as above, the present disclosure provides an apparatus for cooling a metal material including a spray cooling unit for spraying a cooling medium onto a surface of a metal material; and a spraying amount control unit for adjusting a spraying amount of a cooling medium by adjusting a rate of passage of the cooling medium sprayed from the spray cooling unit to an edge region of the metal material.

Preferably, the spray cooling unit may include a main chamber connected to a fluid supply line through which a cooling medium is supplied; and a spraying chamber installed on a front surface of the main chamber in multiple stages along a metal material, and including a spraying line through which a cooling medium is sprayed to the metal material.

Preferably, a plurality of spraying chambers may be installed in the spray cooling unit in multiple stages in a transport direction of the metal material, and a plurality of spraying amount control units may be installed to correspond to the plurality of spraying chambers.

Preferably, the spraying amount control unit may be formed of a breathable material to reduce the flow rate of the sprayed cooling medium by covering the both edge regions of the spraying chamber while rotating along the front surface of the spraying chamber.

Preferably, the spraying amount control unit may include an upper control means for adjusting a flow rate of the cooling medium by covering the spraying line of the edge region of the spraying chamber while rotating from an upper side to a lower side of the spraying chamber; and a lower control means installed to rotate from the lower side to the upper side of the spraying chamber, and adjusting a flow rate of the cooling medium by covering the spraying line of the edge region of the spraying chamber.

Preferably, the spraying amount control unit may include only one of the upper control means and the lower control means.

Preferably, each of the upper control means and the lower control means may include a cover plate body extending in a width direction of the spraying chamber; and a pair of cover members extending in a direction of the spraying line of the spraying chamber from both edge regions of the cover plate body, respectively, and covering the edge region of the spraying line.

Preferably, at least the cover member, among the cover plate body and the cover member, may be formed of a mesh material through which the cooling medium passes, and may have an arc-shaped cross-section to rotate along the front surface of the spraying chamber.

Preferably, the cover member of the upper control means and the cover member of the lower control means may have different lengths extending from the cover plate body.

Preferably, the apparatus may further include an overall spraying mode in which the cooling medium is sprayed through the entire spraying line of the spraying chamber; a first control spraying mode in which a flow rate of the cooling medium is adjusted as the edge region of the spraying line is covered by one side of the upper control means and the lower control means; and a second control spraying mode in which a flow rate of the cooling medium is adjusted as the edge region of the spraying line is covered in an overlapping manner by the upper control means and the lower control means.

Preferably, the apparatus may further include a control driving unit for driving the spraying amount control unit to cover or open the edge region of the spray cooling unit.

Preferably, the control driving unit may include an upper rotating plate installed on both side surfaces of the upper control means of the spraying amount control unit; a lower rotating plate installed on both side surfaces of the lower control means of the spraying amount control unit and hinge-coupled to the upper rotating plate; and a multi-axis control arm for rotating each of the upper rotating plate and the lower rotating plate while moving forwards or backwards by the driving member.

Preferably, the multi-axis control arm may include a control frame moving forwards or backwards by the driving member; an upper control arm having one side hinge-coupled to the control frame and the other side hinge-coupled to the upper rotating plate; and a lower control arm having one side hinge-coupled to the control frame and the other side hinge-coupled to the lower rotating plate.

Preferably, the driving member may include a rotation driving motor installed in the spray cooling unit; a central gearbox connected to a motor shaft of the rotation driving motor; a pair of gear bars connected to the central gearbox in left and right directions; a pair of end gearboxes connected to the pair of gear bars, respectively; and a pair of forward and backward frames connected to the pair of end gearboxes, respectively, and moving the multi-axis control arm forwards or backwards.

Preferably, the forward and backward frame may include a screw bolt member driven to rotate by the end gearbox; and an arm coupling member moving forward and backward by the screw bolt member, and connected to the plurality of multi-axis control arms in a height direction.

Advantageous Effects

According to one aspect of the present disclosure, by preventing surface defects of the metal material by reducing the collision pressure with a metal material, an effect of improving surface quality may be obtained.

According to one aspect of the present disclosure, uniform cooling of an edge region of a metal material may be available through induction refinement of a cooling medium, such that an effect of improving cooling performance may be obtained.

BEST MODE FOR INVENTION

Figure 1:
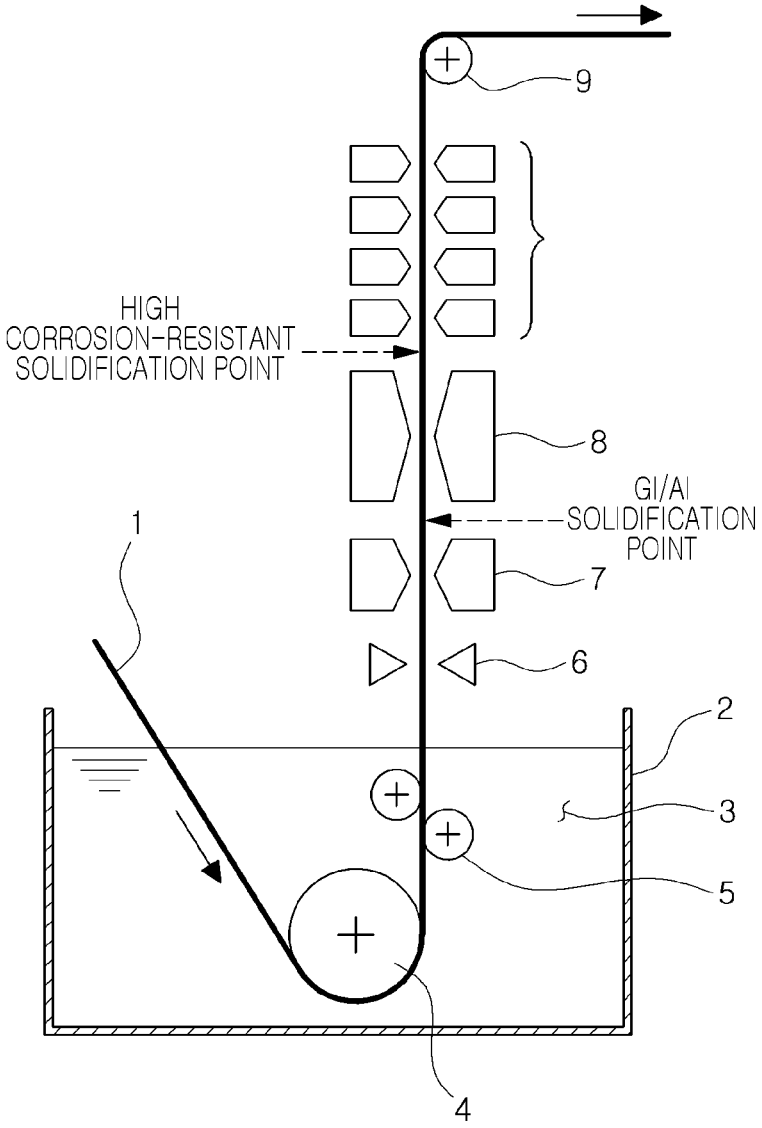
Figure 1 Prior Art
FIG. 1 is a diagram illustrating a plating line of a general metal material.
Figure 2:
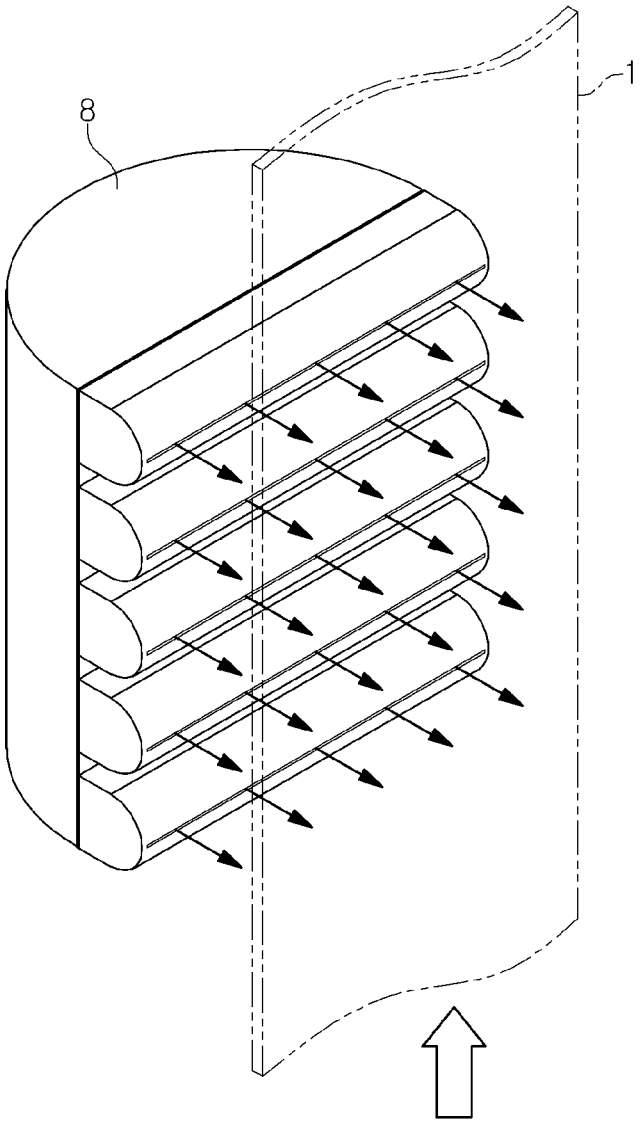
Figure 2 Prior Art
FIG. 2 is a diagram illustrating a state in which a cooling medium is sprayed by an apparatus for cooling a metal material.
Figure 3A:
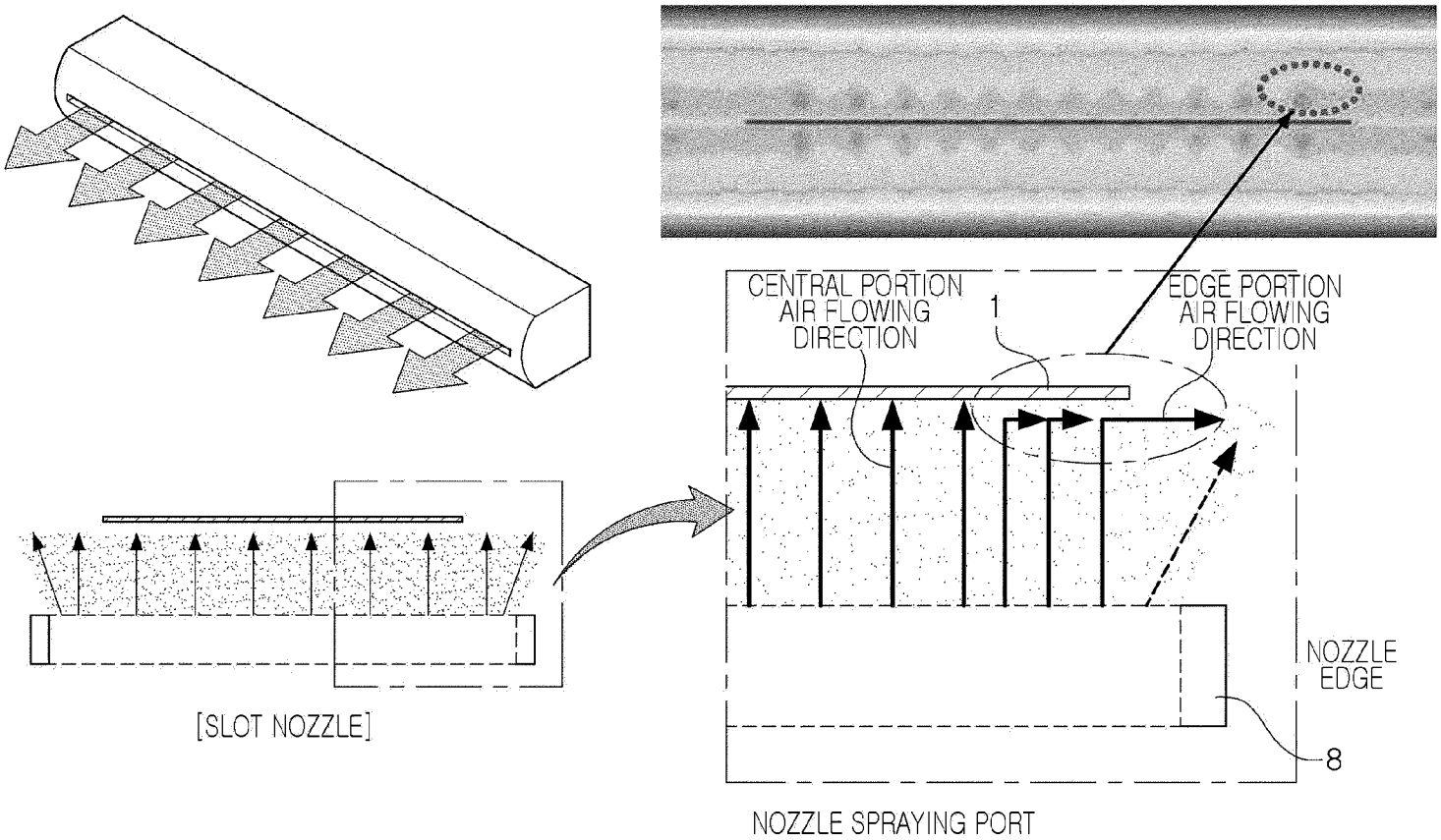
Figure 3a Prior Art
FIGS. 3A and 3B are diagrams illustrating a state in which a cooling medium is sprayed by an apparatus for cooling a metal material.
Figure 3B:
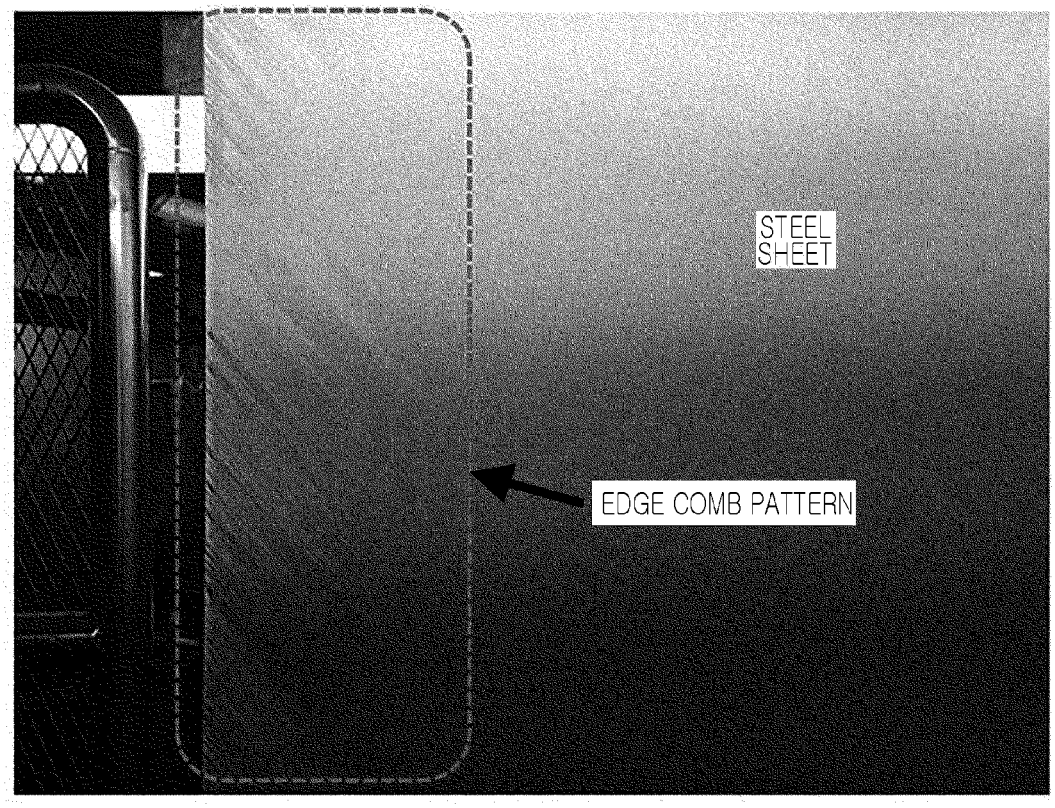
Figure 3b Prior Art

Hereinafter, preferable embodiments of the present disclosure will be described with reference to the accompanied drawings. However, the embodiment of the present disclosure may be modified in various other forms, and the scope of the present disclosure is not limited to the embodiments described below. Also, embodiments of the present disclosure are provided to more completely describe the present disclosure to those with average knowledge in the art. The shapes and sizes of elements in the drawings may be exaggerated for clear description.

Hereinafter, an apparatus for cooling a metal material according to an embodiment of the present disclosure will be described in detail with reference to FIGS. 4 to 7*b*.

The apparatus for cooling a metal material according to an embodiment of the present disclosure may include a spray cooling unit 100 and a spraying amount control unit 200, and may further include a control driving unit 300.

Figure 4A:
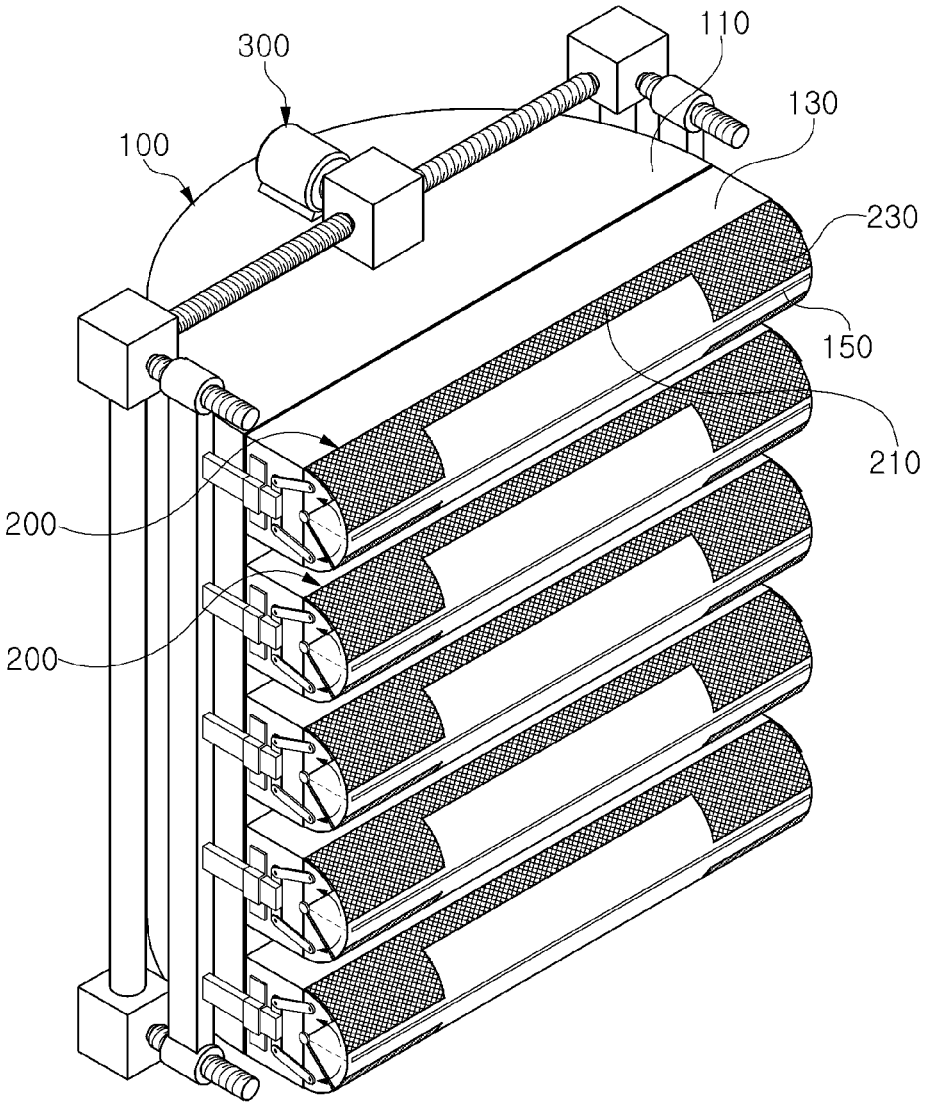
FIGS. 4A and 4B are diagrams illustrating states before and after an operation of a spraying amount control unit of an apparatus for cooling a metal material according to an example embodiment of the present disclosure.
Figure 4B:
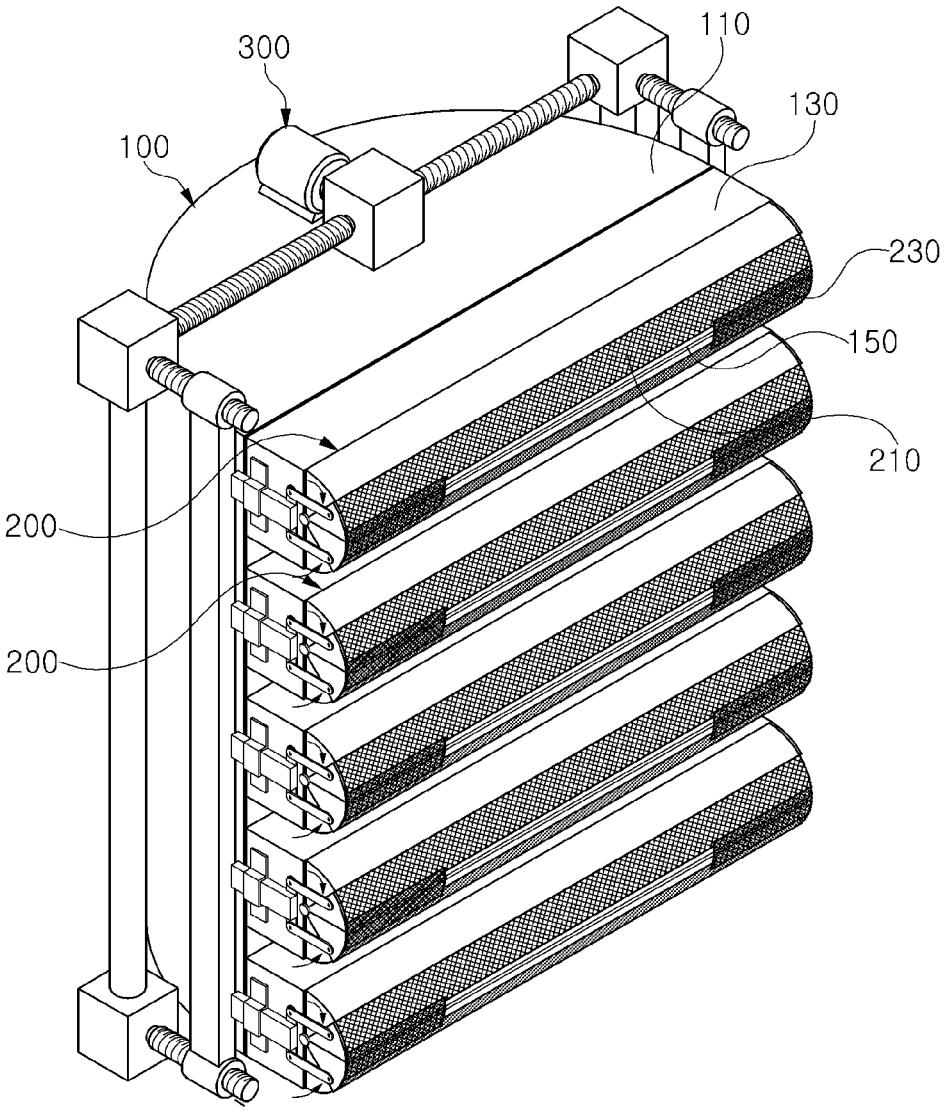

Referring FIGS. 4*a* and 4*b*, the apparatus for cooling a metal material S may include the spray cooling unit 100 for spraying a cooling medium on the surface of the metal material S, and the spraying amount control unit 200 for adjusting the spraying amount of the cooling medium by adjusting a rate of passage of the cooling medium sprayed to the edge region of the metal material S in the spray cooling unit 100.

Figure 5A:
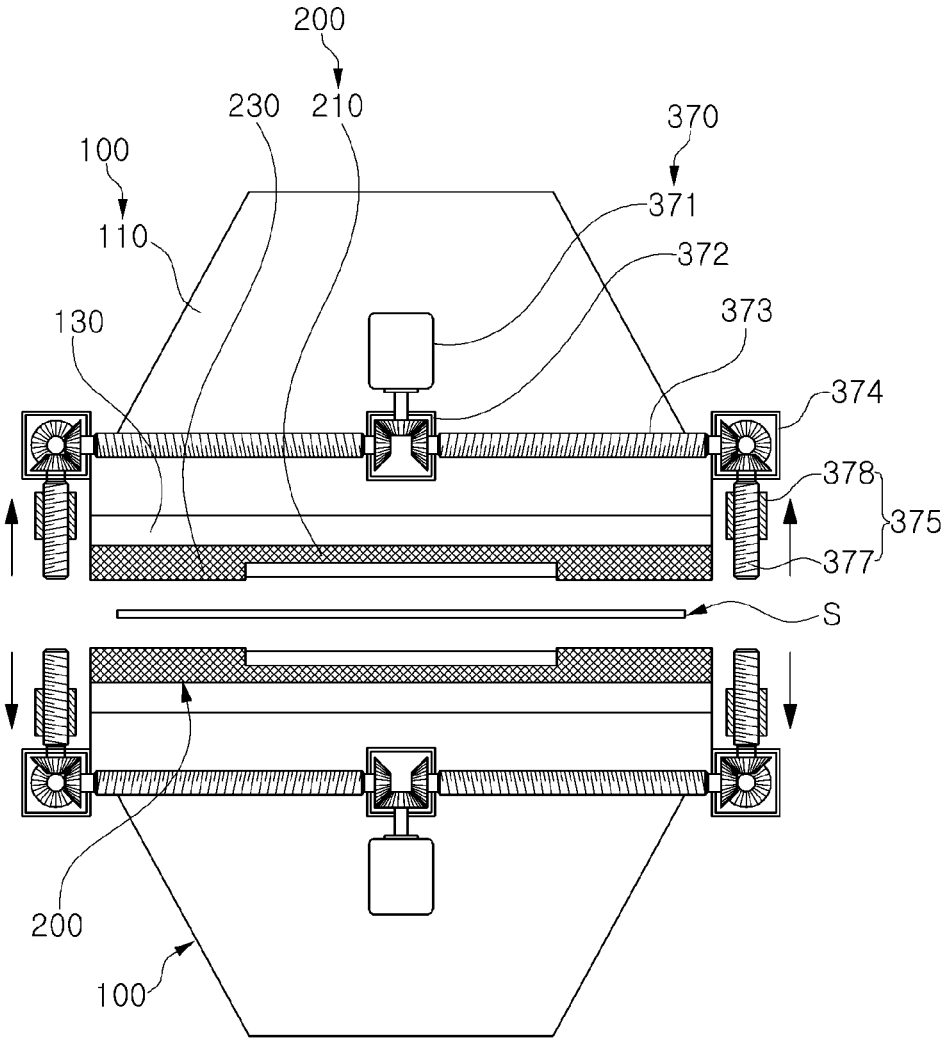
FIGS. 5A and 5B are plan diagrams illustrating states before and after an operation of a spraying amount control unit of an apparatus for cooling a metal material according to an example embodiment of the present disclosure.
Figure 5B:
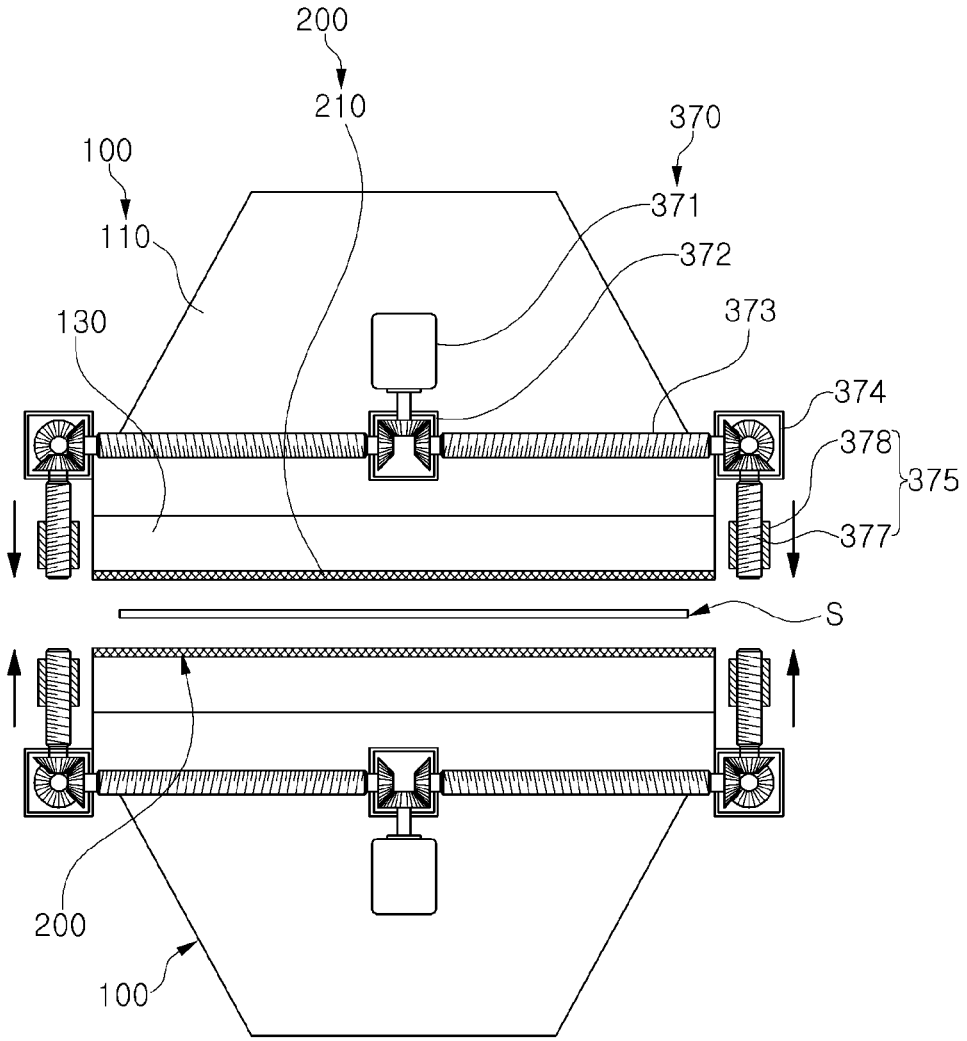

Referring to FIGS. 5*a* and 5*b*, in the present disclosure, a pair of apparatuses for cooling a metal material may oppose each other with the metal material S interposed therebetween.

The pair of spray cooling units 100 may be disposed to oppose each other with the metal material S interposed therebetween to spray the cooling medium onto both side surfaces of the transferred metal material S.

Various types of metals may be applied to the metal material S, an object to be cooled by the apparatus for cooling a metal material in the present disclosure.

For example, the metal material S, an object to be cooled by the apparatus for cooling a metal material in the present disclosure, may be formed of a steel material such as steel or stainless steel.

The metal material S, an object to be cooled in the present disclosure, may be formed of a strip, which may be a thin sheet material.

In this case, a surface of the metal material S may be plated with molten metal such as molten zinc by passing through a plating bath, and may be configured as a strip vertically transported.

Also, the metal material S, an object to be cooled in the present disclosure, may be a strip transferred via at least one of a rough rolling mill and a finishing mill.

The spraying amount control unit 200 may adjust the flow rate of the cooling medium sprayed to the edge region of the metal material S by blocking a portion of a path of the cooling medium sprayed from the spray cooling unit 100 to the edge region of the metal material S.

The spraying amount control unit may attenuate the flow rate of the cooling medium sprayed to the edge region of the metal material S, and may spray and spread the cooling medium widely, thereby refining the flow of the cooling medium.

In the present disclosure, by reducing the collision pressure with the metal material S by reducing the flow rate of the cooling medium sprayed to the edge region of the metal material S by the spraying amount control unit 200, the effect of preventing surface defects occurring in the edge region of the metal material S may be obtained.

In the present disclosure, as the edge region of the metal material S may be uniformly cooled by induction and refinement of the cooling medium by the spraying amount control unit 200, the effect of improving cooling performance may be obtained.

In the present disclosure, by adjusting the spraying amount to the edge region of the metal material S by the spraying amount control unit 200, both edge regions may be relatively rapidly cooled as compared to the central region, such that the temperature deviation of the metal material S in the width direction may be prevented.

Accordingly, an effect that the edge region and the central region of the metal material S may be uniformly rapidly cooled with respect to the entire width of the metal material S may be obtained.

Referring to FIGS. 4*a* and 4*b*, the spray cooling unit 100 may include a main chamber 110 connected to a fluid supply line to which the cooling medium is supplied, and a spraying chamber 130 installed on a front surface of the main chamber 110 in multiple stages along a metal material, and including a spraying line 150 through which a cooling medium is sprayed to the metal material S.

The main chamber 110 may be connected to a fluid supply line (not illustrated) to which the cooling medium is supplied, and a plurality of spraying chambers 130 may be installed in multiple stages in the main chamber 110 in a moving direction of the metal material S.

The front surface of the spraying chamber 130 may be formed in an arc shape, and the spraying amount control unit may move while rotating along the front surface of the spraying chamber 130.

The spraying line 150 may be configured in the form of a slot elongated in the width direction of the metal material S.

For example, the spraying line 150 may be configured as a hole in a rectangular shape having a low height and a long width, and the amount of the cooling medium sprayed along the spraying line 150 may be sprayed almost equally in the width direction.

In this case, as the cooling medium sprayed from the spray cooling unit 100, any fluid including gas, liquid, etc., such as water and air, may be applied.

Referring to FIGS. 4*a* and 4*b*, the spraying amount control unit 200 may be formed of a porous material to reduce a rate of passage of the cooling medium sprayed to the edge region of the metal material S, such that flow rate of the cooling medium sprayed to the edge region of the metal material S may be reduced.

As described above, the reason why the flow rate of the cooling medium sprayed to both edge regions of the metal material S should be reduced is as follows.

As an example, in the case of a high corrosion-resistance thin plated product among steel sheets as the metal material S to which the apparatus for cooling a metal material in the present disclosure is applied, the possibility of an edge defect pattern (blowing mark) on the surface may be low even under the same full-width uniform spraying condition as those of the general GI.

In the case of post-plated products, however, the cooling medium may collide with the steel sheet in the long non-solidification section, and after the collision, the edge defect pattern may be formed in the edge regions of both sides of the steel sheet by the contact flow with the sprayed medium on the surface of the steel sheet.

Therefore, the apparatus for cooling a metal material in the present disclosure may reduce the flow rate of the cooling medium sprayed to both edge regions of the metal material S by the spraying amount control unit 200 such that the edge defect pattern formed in the edge region of the steel sheet may be prevented in advance.

The spraying amount control unit 200 may relatively reduce the spraying amount of the edge region of the metal material S as compared to the spraying amount of the central region of the metal material S.

The spraying amount control unit 200 may not block the path of the cooling medium sprayed to the edge region of the metal material S.

The spraying amount control unit 200 may not block all the paths of the cooling medium sprayed to the metal material S, and may be formed of a breathable material such as a mesh to reduce the flow rate of the cooling medium sprayed to the edge region.

That is, the width direction spray condition of the cooling medium may be changed by the spraying amount control unit 200.

Referring to FIGS. 4*a* and 4*b*, a plurality of spraying chambers 130 may be installed in multiple stages in the spray cooling unit 100 in the transport direction of the metal material S, and a plurality of spraying amount control unit 200 may be installed to correspond to the plurality of spraying chambers 130.

The spraying chamber 130 may be provided on the front side of the main chamber 110, and may be installed in multiple stages in the transport direction of the metal material S.

The spraying amount control unit 200 may be installed to correspond to the spraying chamber 130, and the spraying amount control unit 200 installed on the front surface of each spraying chamber 130 may be driven by the control driving unit 300.

In this case, the plurality of spraying amount control unit 200 installed in multiple stages may be integrally driven by the control driving unit 300 and may integrally adjust the spraying amount of the cooling medium sprayed from the spraying chamber 130 to the edge region of the metal material S.

Referring to FIGS. 4A and 4B, the spraying amount control unit 200 may be formed of a breathable material to reduce the flow rate of the sprayed cooling medium by covering the both edge regions of the spraying chamber 130 while rotating along the front surface of the spraying chamber 130.

Figure 7A:
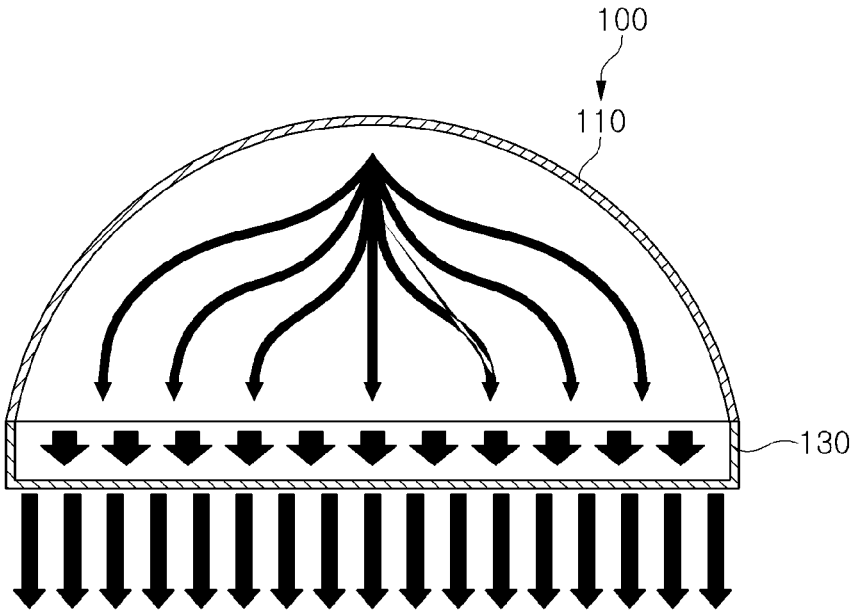
FIGS. 7A and 7B are diagrams illustrating a flow of a cooling medium before and after an operation of a spraying amount control unit of an apparatus for cooling a metal material according to an example embodiment of the present disclosure.
Figure 7B:
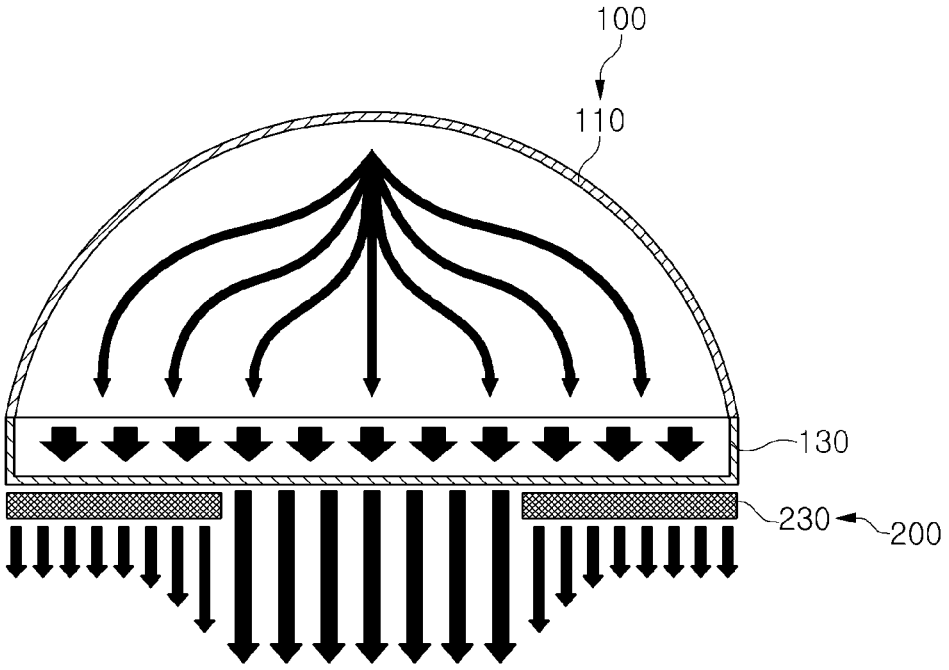

Referring to FIGS. 7A and 7B, by covering at least the edge region of the spraying chamber 130 by the spraying amount control unit 200 formed of a breathable material such as mesh, the flow rate of the cooling medium sprayed to the edge region may be reduced.

Figure 6A:
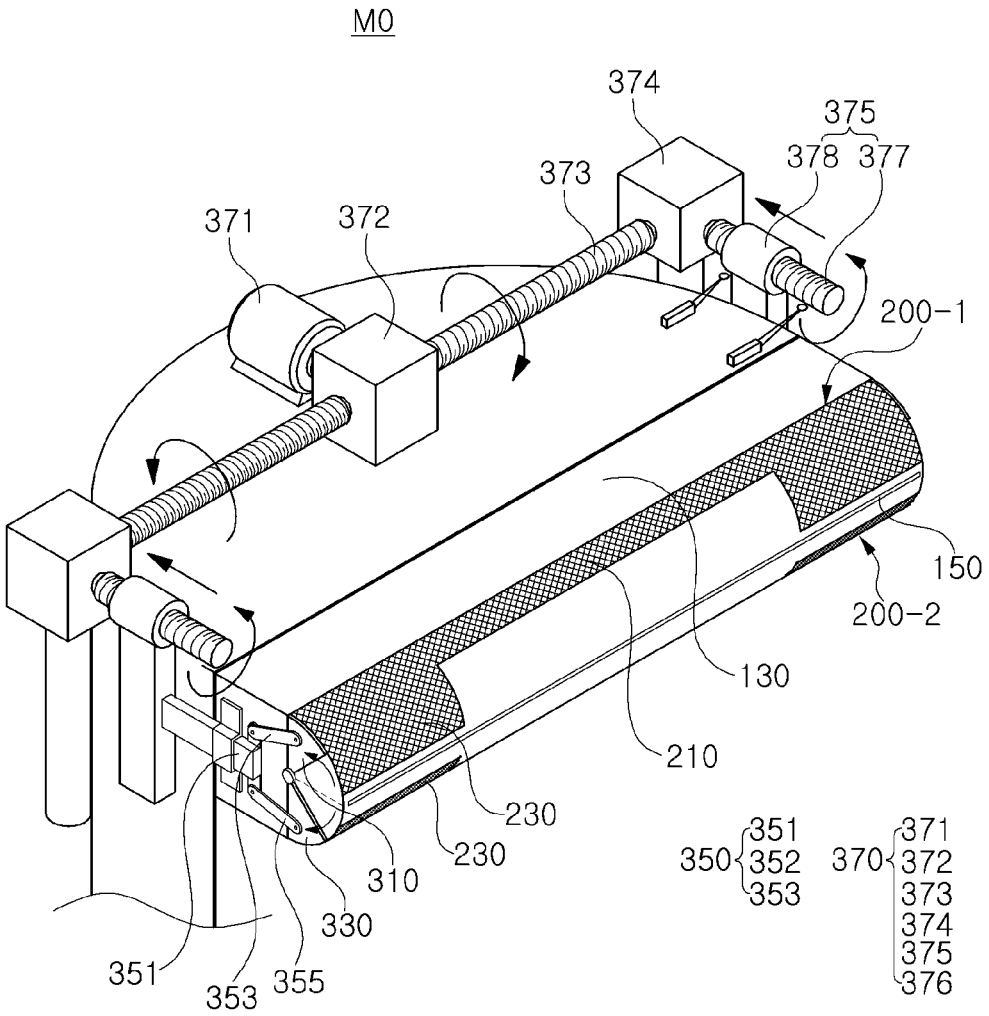
FIGS. 6A to 6C are diagrams illustrating an overall spraying mode, a first control spraying mode, and a second control spraying mode of a spraying amount control unit of an apparatus for cooling a metal material according to an example embodiment of the present disclosure.
Figure 6B:
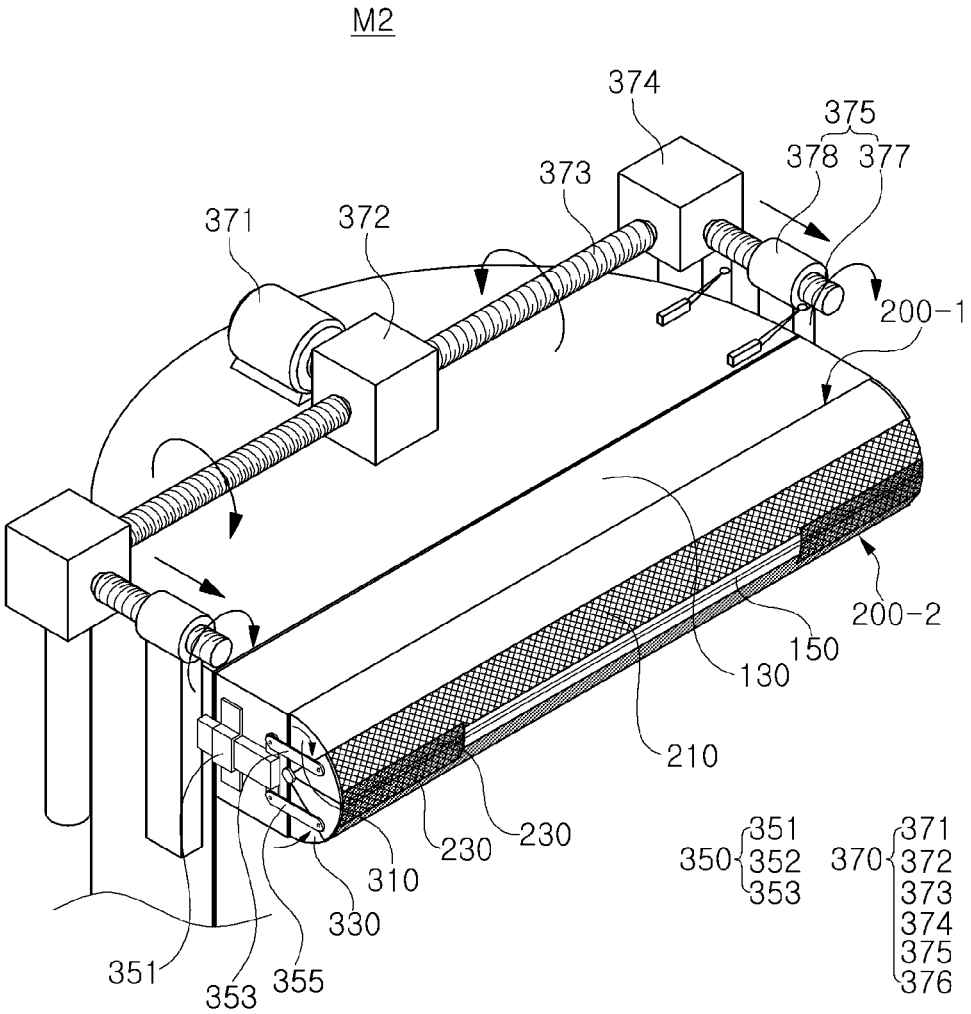
Figure 6C:
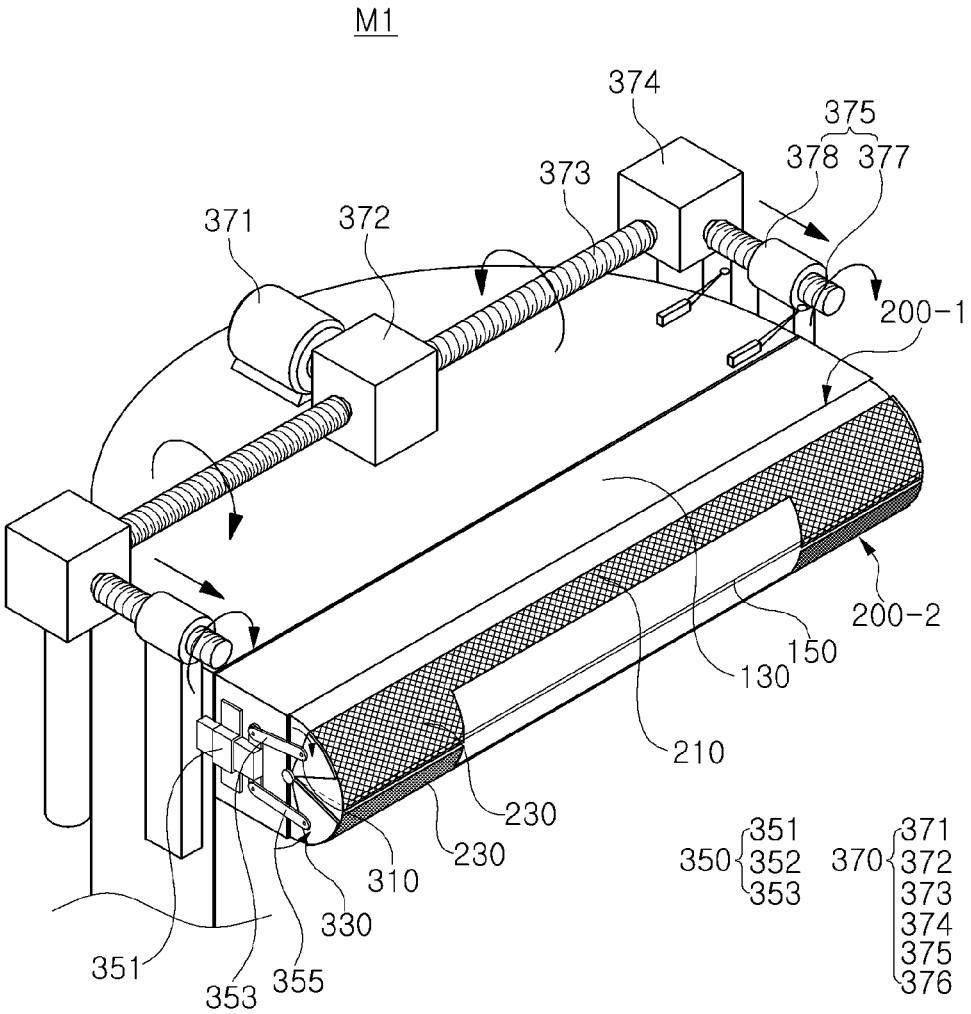

Referring to FIGS. 6*a* to 6*c*, the spraying amount control unit 200 may include an upper control means 200-1 for adjusting the flow rate of the cooling medium by covering the spraying line 150 of the edge region of the spraying chamber 130 while rotating from the upper side to the lower side of the spraying chamber 130, and a lower control means 200-2 installed to rotate from the lower side to the upper side of the spraying chamber, and adjusting the flow rate of the cooling medium by covering the spraying line 150 of the edge region of the spraying chamber 130.

Although not illustrated, the spraying amount control unit 200 may include only one of the upper control means 200-1 and the lower control means 200-2.

Referring to FIGS. 4*a* and 4*b*, the spraying amount control unit 200 may include a cover plate body 210 extending in a width direction of the spraying chamber 130, and a pair of cover members extending in a direction of the spraying line 150 of the spraying chamber 130 from both edge regions of the cover plate body 210, respectively, and covering the edge region of the spraying line 150.

The spraying amount control unit 200 may include a single cover plate body 210 and a pair of cover members 230.

The cover member 230 may be formed of a breathable material such as a mesh and may adjust a rate of passage of the cooling medium sprayed to the edge region of the metal material S, and the cooling medium passing through the cover member 230 may be inductively refined such that uniform rapid cooling of the edge region of the metal material S may be available such that cooling performance may improve.

At least the cover member 230 among the cover plate body 210 and the cover member 230 may be formed of a mesh material through which the cooling medium passes, and may have an arc-shaped cross-section to rotate along the front surface of the spraying chamber 130.

Referring to FIGS. 6*a* to 6*c*, the cover member 230 of the upper control means 200-1 and the cover member 230 of the lower control means 200-2 may have different lengths extending from the cover plate body 210.

A first extension length in which the cover member 230 of the upper control means 200-1 extends from the cover plate body 210 may be relatively longer than a second extension length in which the cover member 230 of the lower control means 200-2 extends from the cover plate body 210.

Accordingly, as illustrated in FIG. 6*c*, even when the upper control means 200-1 and the lower control means 200-2 integrally rotate together by the control driving unit 300, the cover member 230 of the upper control means 200-1 may cover the spraying line 150 of the spraying chamber 130, and the cover member 230 of the lower control means 200-2 may not cover the spraying line 150 of the spraying chamber 130, depending on the degree of rotation.

As illustrated in FIG. 6*b*, the cover member 230 of the upper control means 200-1 and the cover member 230 of the lower control means 200-2 may cover the spraying line 150 of the spraying chamber 130 in an overlapping manner.

Also, as illustrated in FIG. 6*a*, both the cover member 230 of the upper control means 200-1 and the cover member 230 of the lower control means 200-2 may not cover the spraying line 150 of the spraying chamber 130.

The apparatus for cooling a metal material in the present disclosure may include an overall spraying mode M0 in which the cooling medium is sprayed through the entire spraying line 150 of the spraying chamber 130, a first control spraying mode M1 in which a flow rate of the cooling medium may be adjusted as the edge region of the spraying line is covered by one side of the upper control means 200-1 and the lower control means 200-2, and a second control spraying mode M2 in which a flow rate of the cooling medium may be adjusted as the edge region of the spraying line 150 is covered in an overlapping manner by the upper control means 200-1 and the lower control means 200-2.

Referring to FIGS. 4*a* and 4*b*, the apparatus for cooling a metal material may further include a control driving unit 300 for driving the spraying amount control unit 200 to cover or open the edge region of the spray cooling unit 100.

The control driving unit 300 may adjust the spraying amount of the cooling medium sprayed to the edge region of the spray cooling unit 100 by driving the spraying amount control unit 200.

Referring to FIGS. 6*a* to 6*c*, the control driving unit 300 may include an upper rotating plate 310 installed on both side surfaces of the upper control means 200-1, a lower rotating plate 330 installed on both side surfaces of the lower control means 200-2 and hinge-coupled to the upper rotating plate 310, and a multi-axis control arm for rotating each of the upper rotating plate 310 and the lower rotating plate 330 while moving forwards or backwards by the driving member 370.

The upper rotating plate 310 and the lower rotating plate 330 may be hinge-coupled to the side surface of the spraying chamber 130.

As the upper rotating plate 310 rotates, the upper control means 200-1 coupled to the upper rotating plate 310 may rotate along the front surface of the spraying chamber 130, and as the lower rotating plate 330 rotates, the lower control means 200-2 coupled to the lower rotating plate 330 may rotate along the front surface of the spraying chamber 130.

A pair of the upper rotating plates 310 may be installed on both side surfaces of the spraying chamber 130, respectively, and may rotatably support the both side surfaces of the upper control means 200-1.

A pair of lower rotating plates 330 may be installed on both side surfaces of the spraying chamber 130, respectively, and may rotatably support both side surfaces of the lower control means 200-2.

The upper rotating plate 310 and the lower rotating plate 330 may be hinge-coupled to the side surface of the spraying chamber 130 via a shaft, and may rotate in an arc shape around the shaft.

Referring to FIGS. 6*a* to 6*c*, the multi-axis control arm 350 may be hinge-coupled to each of the upper rotating plate 310 and the lower support plate.

The multi-axis control arm 350 may integrally rotate the upper rotating plate 310 and the lower rotating plate 330 hinge-coupled to the multi-axis control arm 350 when moving forwards or backwards by the driving member 370.

When the multi-axis control arm 350 moves forward by the driving member 370, the upper rotating plate 310 may move upwardly in an arc shape while the upper control means 200-1 moves upwardly in an arc shape along the front of the spraying chamber 130, and the lower rotating plate 330 may move downwardly in an arc shape while the lower control means 200-2 moves downwardly in an arc shape along the front surface of the spraying chamber 130.

An operation state of the upper control means 200-1 and the lower control means 200-2 when the multi-axis control arm 350 moves forward and backward will be described as below with reference to FIGS. 6*a* to 6*c*.

When the multi-axis control arm 350 moves forward by the driving member 370, the upper control means 200-1 may move upwardly in an arc shape, and the lower control means 200-2 may move downwardly in an arc shape, such that the cooling medium may be sprayed to the edge region and the central region of the metal material S at the same flow rate.

The edge region of the spraying line 150 of the spraying chamber 130 may not be covered but may be opened, such that the flow rates of the cooling medium sprayed to the central region and the edge region may be equal.

When the multi-axis control arm 350 moves backward by the driving member 370, the upper rotating plate 310 may move downwardly in an arc shape while the upper control means 200-1 moves downwardly in an arc shape along the front of the spraying chamber 130. The lower rotating plate 330 may move upwardly in an arc shape while the lower control means 200-2 moves upwardly in an arc shape along the front surface of the spraying chamber 130.

That is, when the multi-axis control arm 350 moves forward by the driving member 370, the upper control means 200-1 may move downwardly in an arc shape, and the lower control means 200-2 may move upwardly in an arc shape, such that the flow rate of the cooling medium sprayed to the edge region of the metal material S may be reduced.

While the edge region of the spraying line 150 of the spraying chamber 130 is covered, the flow rate of the cooling medium sprayed to the edge region of the metal material S may be smaller than the flow rate thereof sprayed to the central region.

Referring to FIGS. 6*a* to 6*c*, the multi-axis control arm 350 may include a control frame 351 moving forward and backward by the driving member 370, an upper control arm 353 having one side hinge-coupled to the control frame 351 and the other side hinge-coupled to the upper rotating plate 310, and a lower control arm 355 having one side hinge-coupled to the control frame 351 and the other side hinge-coupled to the lower rotating plate 330.

Referring to FIGS. 5*a* and 5*b*, the driving member 370 may include a rotation driving motor 371 installed in the spray cooling unit 100, a central gearbox 372 connected to a motor shaft of the rotation driving motor 371, a pair of gear bars 373 connected to the central gearbox 372 in left and right directions, a pair of end gearboxes 374 connected to the pair of gear bars 373, respectively, and a pair of forward and backward frames 375 connected to the pair of end gearboxes 374, respectively, and moving the multi-axis control arm 350 forwards or backwards.

The gear bar 373 may have one end connected to the side gearbox, and the other end connected to the central gearbox 372.

The central gearbox 372 and the end gearbox 374 may transmit a rotational force transmitted from the rotation driving motor 371 through a barbell gear installed therein.

The driving operation of the driving member 370 will be described as follows with reference to FIGS. 5A and 5B.

A barbell gear may be formed on each of one end of a motor shaft of the rotation driving motor 371 and the pair of gear bars 373, may be engaged in the central gear box 372, and a rotational force may be transmitted from the motor shaft of the rotation driving motor 371 to the gear bar 373.

A barbell gear may be formed on the other end of the pair of gear bars 373 and on one end (upper end) of the screw bolt member 377 of the forward and backward frame 375 connected to the gear bar 373, and the barbell gear may be engaged in the end gearbox 374 such that the rotational force of the gear bar 373 may be transmitted to the screw bolt member 377 of the forward and backward frame 375.

As the screw bolt member 377 rotates, the arm coupling member 378 of the forward and backward frame 375 may move backward and forward, and the plurality of multi-axis control arms installed in the arm coupling member 378 and spaced apart from each other in the height direction may integrally operate such that the plurality of spraying amount control units 200 coupled to the upper rotating plate 310 and the lower rotating plate 330, respectively, may be simultaneously adjusted.

The forward and backward frame 375 may include a screw bolt member 377 driven to rotate by the end gearbox 374, and an arm coupling member moving forward and backward by the screw bolt member, and connected to the plurality of multi-axis control arms in a height direction.

While the example embodiments have been illustrated and described above, it will be apparent to those skilled in the art that modifications and variations could be made without departing from the scope of the present disclosure as defined by the appended claims.

The invention claimed is:

1. An apparatus for cooling a metal material, comprising:

a spray cooling unit for spraying a cooling medium to a surface of a metal material; and a spraying amount control unit for adjusting a spraying amount of a cooling medium by adjusting a rate of passage of the cooling medium sprayed from the spray cooling unit to an edge region of the metal material, wherein the spray cooling unit includes: a main chamber connected to a fluid supply line through which a cooling medium is supplied; and a spraying chamber installed on a front surface of the main chamber in multiple stages along a metal material, and including a spraying line through which a cooling medium is sprayed to the metal material, and wherein the spraying amount control unit is formed of a breathable material to reduce the flow rate of the sprayed cooling medium by covering the both edge regions of the spraying chamber while rotating along the front surface of the spraying chamber.

2. The apparatus of claim 1, wherein a plurality of spraying chambers are installed in the spray cooling unit in multiple stages in a transport direction of the metal material, and wherein a plurality of spraying amount control units are installed to correspond to the plurality of spraying chambers.

3. The apparatus of claim 1, wherein the spraying amount control unit includes:

an upper control means for adjusting a flow rate of the cooling medium by covering the spraying line of the edge region of the spraying chamber while rotating from an upper side to a lower side of the spraying chamber; and a lower control means installed to rotate from the lower side to the upper side of the spraying chamber, and adjusting a flow rate of the cooling medium by covering the spraying line of the edge region of the spraying chamber.

4. The apparatus of claim 3, wherein the spraying amount control unit includes only one of the upper control means and the lower control means.

5. The apparatus of claim 3, wherein each of the upper control means and the lower control means includes:

a cover plate body extending in a width direction of the spraying chamber; and a pair of cover members extending in a direction of the spraying line of the spraying chamber from both edge regions of the cover plate body, respectively, and covering the edge region of the spraying line.

6. The apparatus of claim 5, wherein at least the cover member, among the cover plate body and the cover member, is formed of a mesh material through which the cooling medium passes, and has an arc-shaped cross-section to rotate along the front surface of the spraying chamber.

7. The apparatus of claim 5, wherein the cover member of the upper control means and the cover member of the lower control means have different lengths extending from the cover plate body.

8. The apparatus of claim 3, further comprising:

an overall spraying mode in which the cooling medium is sprayed through the entire spraying line of the spraying chamber;

a first control spraying mode in which a flow rate of the cooling medium is adjusted as the edge region of the spraying line is covered by one side of the upper control means and the lower control means; and a second control spraying mode in which a flow rate of the cooling medium is adjusted as the edge region of the spraying line is covered in an overlapping manner by the upper control means and the lower control means.

9. The apparatus of claim 1, further comprising:

a control driving unit for driving the spraying amount control unit to cover or open the edge region of the spray cooling unit.

10. The apparatus of claim 9, wherein the control driving unit includes:

an upper rotating plate installed on both side surfaces of the upper control means of the spraying amount control unit;

a lower rotating plate installed on both side surfaces of the lower control means of the spraying amount control unit and hinge-coupled to the upper rotating plate; and a multi-axis control arm for rotating each of the upper rotating plate and the lower rotating plate while moving forwards or backwards by the driving member.

11. The apparatus of claim 10, wherein the multi-axis control arm includes:

a control frame moving forwards or backwards by the driving member;

an upper control arm having one side hinge-coupled to the control frame and the other side hinge-coupled to the upper rotating plate; and a lower control arm having one side hinge-coupled to the control frame and the other side hinge-coupled to the lower rotating plate.

12. The apparatus of claim 11, wherein the driving member includes:

a rotation driving motor installed in the spray cooling unit;

a central gearbox connected to a motor shaft of the rotation driving motor;

a pair of gear bars connected to the central gearbox in left and right directions;

a pair of end gearboxes connected to the pair of gear bars, respectively; and a pair of forward and backward frames connected to the pair of end gearboxes, respectively, and moving the multi-axis control arm forwards or backwards.

13. The apparatus of claim 12, wherein the forward and backward frame includes:

a screw bolt member driven to rotate by the end gearbox; and an arm coupling member moving forward and backward by the screw bolt member, and connected to the plurality of multi-axis control arms in a height direction.

14. An apparatus for cooling a metal material, comprising:

a spray cooling unit for spraying a cooling medium to a surface of a metal material; and a spraying amount control unit for adjusting a spraying amount of a cooling medium by adjusting a rate of passage of the cooling medium sprayed from the spray cooling unit to an edge region of the metal material, wherein the spray cooling unit includes: a main chamber connected to a fluid supply line through which a cooling medium is supplied; and a spraying chamber installed on a front surface of the main chamber in multiple stages along a metal material, and including a spraying line through which a cooling medium is sprayed to the metal material, and wherein the spraying amount control unit includes: an upper control means for adjusting a flow rate of the cooling medium by covering the spraying line of the edge region of the spraying chamber while rotating from an upper side to a lower side of the spraying chamber; and a lower control means installed to rotate from the lower side to the upper side of the spraying chamber, and adjusting a flow rate of the cooling medium by covering the spraying line of the edge region of the spraying chamber.

15. The apparatus of claim 14, wherein the spraying amount control unit includes only one of the upper control means and the lower control means.

16. The apparatus of claim 14, wherein each of the upper control means and the lower control means includes:

a cover plate body extending in a width direction of the spraying chamber; and a pair of cover members extending in a direction of the spraying line of the spraying chamber from both edge regions of the cover plate body, respectively, and covering the edge region of the spraying line.

17. The apparatus of claim 16, wherein at least the cover member, among the cover plate body and the cover member, is formed of a mesh material through which the cooling medium passes, and has an arc-shaped cross-section to rotate along the front surface of the spraying chamber.

18. The apparatus of claim 16, wherein the cover member of the upper control means and the cover member of the lower control means have different lengths extending from the cover plate body.

19. An apparatus for cooling a metal material, comprising:

a spray cooling unit for spraying a cooling medium to a surface of a metal material;

a spraying amount control unit for adjusting a spraying amount of a cooling medium by adjusting a rate of passage of the cooling medium sprayed from the spray cooling unit to an edge region of the metal material; and a control driving unit for driving the spraying amount control unit to cover or open the edge region of the spray cooling unit, wherein the control driving unit includes:

an upper rotating plate installed on both side surfaces of the upper control means of the spraying amount control unit;

a lower rotating plate installed on both side surfaces of the lower control means of the spraying amount control unit and hinge-coupled to the upper rotating plate; and a multi-axis control arm for rotating each of the upper rotating plate and the lower rotating plate while moving forwards or backwards by the driving member.

20. The apparatus of claim 19, wherein the multi-axis control arm includes:

a control frame moving forwards or backwards by the driving member;

an upper control arm having one side hinge-coupled to the control frame and the other side hinge-coupled to the upper rotating plate; and a lower control arm having one side hinge-coupled to the control frame and the other side hinge-coupled to the lower rotating plate.

* * * * *